US011154828B2

(12) United States Patent
Snezhko et al.

(10) Patent No.: US 11,154,828 B2
(45) Date of Patent: Oct. 26, 2021

(54) TURBULENT MIXING BY MICROSCOPIC SELF-ASSEMBLED SPINNERS

(71) Applicant: UCHICAGO ARGONNE, LLC, Chicago, IL (US)

(72) Inventors: Oleksiy Snezhko, Naperville, IL (US); Gasper Kokot, Westmont, IL (US)

(73) Assignee: UChicago Argonne, LLC, Chicago, IL (US)

( * ) Notice: Subject to any disclaimer, the term of this patent is extended or adjusted under 35 U.S.C. 154(b) by 529 days.

(21) Appl. No.: 16/131,919

(22) Filed: Sep. 14, 2018

(65) Prior Publication Data

US 2020/0086286 A1 Mar. 19, 2020

(51) Int. Cl.

| | |
|---|---|
| ***B01F 13/08*** | (2006.01) |
| ***B01F 3/12*** | (2006.01) |
| ***B01F 13/00*** | (2006.01) |

(52) U.S. Cl.

CPC ..... *B01F 13/0818* (2013.01); *B01F 3/1221* (2013.01); *B01F 13/0006* (2013.01); *B01F 13/0809* (2013.01)

(58) Field of Classification Search

CPC B01F 13/0818; B01F 3/1221; B01F 13/0049; B01F 13/0059; B01F 13/0076; B01F 13/0006; B01F 13/0077; B01F 13/0809

See application file for complete search history.

(56) References Cited

U.S. PATENT DOCUMENTS

| | | | | |
|---|---|---|---|---|
| 4,310,253 | A * | 1/1982 | Sada | B01F 13/0809 261/84 |
| 4,936,687 | A | 6/1990 | Lilja et al. | |
| 5,414,506 | A | 5/1995 | Saisho et al. | |
| 6,500,343 | B2 | 12/2002 | Siddiqi | |
| 6,764,859 | B1 * | 7/2004 | Kreuwel | C12Q 1/6806 436/178 |
| 6,902,313 | B2 | 6/2005 | Ho et al. | |
| 7,875,187 | B2 * | 1/2011 | Snezhko | B03C 1/288 210/695 |
| 8,034,245 | B1 * | 10/2011 | Snezhko | B03C 1/288 210/695 |
| 8,398,295 | B2 * | 3/2013 | Yellen | B03C 1/02 366/273 |
| 8,871,420 | B1 * | 10/2014 | Liu | B01F 13/0818 430/137.19 |
| 9,099,233 | B2 * | 8/2015 | Aronson | B03C 1/0335 |

(Continued)

OTHER PUBLICATIONS

Angelini, et al., "Glass-like dynamics of collective cell migration," Proceedings of the National Academy of Sciences USA 108(12), pp. 4714-4719 (2011).

(Continued)

*Primary Examiner* — Charles Cooley
(74) *Attorney, Agent, or Firm* — Foley & Lardner LLP

(57) ABSTRACT

A system for mixing particles that includes a liquid comprising inert particles and defining a liquid and air interface; magnetic microparticles suspended at the liquid and air interface; and a magnetic source configured to apply a uniaxial alternating magnetic field parallel to the liquid and air interface, wherein the uniaxial alternating magnetic field promotes a turbulent motion of the magnetic microparticles, which in turn promotes a diffusive motion of the inert particles.

23 Claims, 7 Drawing Sheets

(56) References Cited

U.S. PATENT DOCUMENTS

| | | | | |
|---|---|---|---|---|
| 9,234,090 | B2 * | 1/2016 | Liu | C09C 1/48 |
| 9,358,513 | B2 * | 6/2016 | Liu | B01F 13/0809 |
| 9,579,658 | B2 | 2/2017 | Zhou et al. | |
| 9,656,225 | B2 * | 5/2017 | Liu | B01F 13/0809 |
| 9,707,716 | B2 | 7/2017 | Demortiere et al. | |
| 10,066,115 | B2 * | 9/2018 | Zhou | B02C 17/005 |
| 10,639,602 | B2 * | 5/2020 | Frodsham | B03C 1/0332 |
| 2007/0215478 | A1 * | 9/2007 | Snezhko | B03C 1/288 204/660 |
| 2011/0262893 | A1 * | 10/2011 | Dryga | C07K 16/1267 435/5 |
| 2013/0075648 | A1 * | 3/2013 | Aronson | B03C 1/0335 252/62.51 R |
| 2014/0305340 | A1 * | 10/2014 | Liu | G03G 9/0804 106/473 |
| 2020/0086286 | A1 * | 3/2020 | Snezhko | B01F 13/0049 |

OTHER PUBLICATIONS

Belkin, et al., "Magnetically driven surface mixing," Physical Review E 80, 011310, 5 pages (2009).
Belkin, et al., "Model for dynamic self-assembled magnetic surface structures," Physical Review E 82, 015301(R), 5 pages (2010).
Boffetta & Ecke, "Two-Dimensional Turbulence," Annual Review of Fluid Mechanics 44, pp. 427-451 (2012).
Bratanov, et al., "New class of turbulence in active fluids," Proceedings of the National Academy of Sciences USA 112(49), pp. 15048-15053 (2015).
Buhl, et al., "From disorder to order in marching locusts," Science 312(5778), pp. 1402-1406 (2006).
Cavagna, et al., "Scale-free correlations in starling flocks," Proceedings of the National Academy of Sciences USA 107(26), pp. 11865-11870 (2010).
Climent, et al., "Dynamic self-assembly of spinning particles," Journal of Fluids Engineering 129(4), pp. 379-387 (2006).
Deutsch, et al., "Collective motion in biological systems," Interface Focus 2, 4 pages (2012).
Dombrowski, et al., "Self-concentration and large-scale coherence in bacterial dynamics," Physical Review Letters 93(9), 098103, 4 pages (2004).
Driscoll, et al., "Unstable fronts and motile structures formed by microrollers," Nature Physics 13, pp. 375-379 (2017).
Dunkel, et al., "Fluid dynamics of bacterial turbulence," Physical Review Letters 110, 228102, 5 pages (2013).
Eisenstecken, et al., "Internal dynamics of semiflexible polymers with active noise," The Journal of Chemical Physics 146, 154903, X pages (2017).
Esmaeeli & Tryggvason, "An inverse energy cascade in two-dimensional low Reynolds number bubbly flows," Journal of Fluid Mechanics 314, pp. 315-330 (1996).
Gompper, et al., "Multi-particle collision dynamics: A particle-based mesoscale simulation approach to the hydrodynamics of complex fluids," Advances in Polymer Science 221, 91 pages (2009).
Goto & Tanaka, "Purely hydrodynamic ordering of rotating disks at a finite Reynolds number," Nature Communications 6, 5994, 10 pages (2015).
Gotze & Gompper, "Flow generation by rotating colloids in planar microchannels," Europhysics Letters 92(6), 6 pages (2011).
Groisman & Steinberg, "Elastic turbulence in a polymer solution flow," Nature 405, pp. 53-55 (2000).
Gryzbowski, et al., "Dynamic self-assembly of magnetized, millimetre-sized objects rotating at a liquid$2013air interface," Nature 405, pp. 1033-1036 (2000).
Huang, et al., "Hydrodynamic correlations in multiparticle collision dynamics fluids," Physical Review E 86, 056711, 10 pages (2012).
Kaiser, et al., "Flocking ferromagnetic colloids," Science Advances 3(2), e1601469, 10 pages (2017).
Kapral, "Multiparticle collision dynamics: Simulation of complex systems on mesoscales," Advances in Chemical Physics 140, pp. 89-146 (2008).
Kellay & Goldburg, "Two-dimensional turbulence: a review of some recent experiments," Reports on Progress in Physics 65(5), 50 pages (2002).
Kokot, et al., "Emergence of reconfigurable wires and spinners via dynamic self-assembly," Scientific Reports 5:9528, 8 pages (2015).
Lance & Bataille, "Turbulence in the liquid phase of a uniform bubbly air-water flow," Journal of Fluid Mechanics 222, pp. 95-118 (1991).
Leptos, et al., "Dynamics of enhanced tracer diffusion in suspensions of swimming eukaryotic microorganisms," Physical Review Letters 103, 198103, 4 pages (2009).
Maier & Fischer, "Transport on active paramagnetic colloidal networks," Journal of Physical Chemistry B 120(38), pp. 10162-10165 (2016).
Martin & Snezhko, "Driving self-assembly and emergent dynamics in colloidal suspensions by time-dependent magnetic fields," Reports on Progress in Physics 76(12), 126601 (2013).
Mudde, et al., "Liquid velocity field in a bubble column: LDA experiments," Chemical Engineering Science 52(21-22), pp. 4217-4224 (1997).
Nguyen, et al,. "Emergent collective phenomena in a mixture of hard shapes through active rotation," Physicasl Review Letters 112, 075701, 5 pages (2014).
Noguchi & Gompper, "Transport coefficients of off-lattice mesoscalehydrodynamics simulation techniques," Physical Review E 78, 016706, 13 pages (2008).
Patteson, et al., "Particle diffusion in active fluids is non-monotonic in size," Soft Matter 12(8), pp. 2365-2372 (2016).
Sanchez, et al., "Spontaneous motion in hierarchically assembled active matter," Nature 491, pp. 431-434 (2012).
Snezhko & Aranson, "Magnetic manipulation of self-assembled colloidal asters," Nature Materials 10, pp. 698-703 (2011).
Snezhko & Aranson, "Velocity statistics of dynamic spinners in out-of-equilibrium magnetic suspensions," Soft Matter 11(30), pp. 6055-6061 (2015).
Snezhko, "Non-equilibrium magnetic colloidal dispersions at liquid-air interfaces: Dynamic patterns, magnetic order and self-assembled swimmers," Journal of Physics: Condensed Matter 23(15), 22 pages (2011).
Snezhko, et al., "Self-assembled magnetic surface swimmers," Physical Review Letters 102, 118103, 5 pages (2009).
Sokolov & Aranson, "Physical properties of collective motion in suspensions of bacteria," Physical Review Letters 109, 248109, 5 pages (2012).
Sokolov, et al., "Enhanced mixing and spatial instability in concentrated bacterial suspensions," Physical Review E 80, 031903, 8 pages (2009).
Solis & Martin, "Complex magnetic fields breathe life into fluids," Soft Matter 10(45), pp. 9136-9142 (2014).
Theers, et al., "From local to hydrodynamic friction in Brownian motion: A multi-particle collision dynamics simulation study," Physical Review E 93, 032604, 13 pages (2016).
Tierno, "Depinning and collective dynamics of magnetically driven colloidal monolayers," Physical Review Letters 109, 198304, 5 pages (2012).
Van Zuiden, et al., "Spatiotemporal order and emergent edge currents in active spinner materials," Proceedings of the National Academy of Sciences USA 113(46), pp. 12919-12924 (2016).
Vazquez-Quesada, et al., "Theory and simulation of the dynamics, deformation, and breakup of a chain of superparamagnetic beads under a rotating magnetic field," Physics of Fluids 29, 032006, X pages (2017).
Vissers, et al., "Band formation in mixtures of oppositely charged colloids driven by an ac electric field," Physical Review Letters 106, 228303, 4 pages (2011).
Wang, et al., "From one to many: Dynamic assembly and collective behavior of self-propelled colloidal motors," Accounts of Chemical Research 48(7), pp. 1938-1948 (2015).

(56) References Cited

OTHER PUBLICATIONS

Wensing & Lowen, "Emergent states in dense systems of active rods: From swarming to turbulence," Journal of Physics: Condensed Matter 24(46), 14 pages (2012).
Wensink, et al., "Meso-scale turbulence in living fluids," Proceedings of the National Academy of Sciences USA 109(36), pp. 14308-14313 (2012).
Wu & Libchaber, "Particle diffusion in a quasi-two-dimensional bacterial bath," Physical Review Letters 84, 3017, 4 pages (2000).
Xu, et al., "Flight-crash events in turbulence," Proceedings of the National Academy of Sciences USA 111(21), pp. 7558-7563 (2014).
Yan, et al., "Linking synchronization to self-assembly using magnetic janus colloids," Nature 491, pp. 578-581 (2012).
Yeo, et al., "Collective dynamics in a binary mixture of hydrodynamically coupled microrotors," Physical Review Letters 114, 188301, 9 pages (2015).

* cited by examiner

TURBULENT MIXING BY MICROSCOPIC SELF-ASSEMBLED SPINNERS

STATEMENT OF GOVERNMENT INTEREST

This invention was made with government support under Contract No. DE-AC02-06CH11357 awarded by the United States Department of Energy to UChicago Argonne, LLC, operator of Argonne National Laboratory. The government has certain rights in the invention.

TECHNICAL FIELD

The present application relates to a method of using an ensemble of magnetic micro-particles suspended on the surface of a liquid and energized by an in-plane single-axis magnetic field to provide efficient mixing at both micro and macro scales.

BACKGROUND

This section provides a context of the invention recited in the claims. The description herein may include concepts that could be pursued, but are not necessarily ones that have been previously conceived or pursued. Thus, unless expressly indicated as such herein, what is described in this section is not prior art to the description and the claims herein and is not admitted to be prior art by inclusion in this section.

Turbulent fluid motion can be found in nature and across diverse length and time scales, ranging from high-Reynolds number hydrodynamic turbulence to active turbulence (e.g., active fluids), such as bacterial suspensions and cytoskeletal extracts. In contrast to hydrodynamic turbulence, active turbulence formally occurs at exceedingly small Reynolds numbers, rendering the fluid inertia negligible. Not surprisingly, statistical properties of active turbulence appear to be different from those involving hydrodynamic turbulence, since, for example, active turbulence is believed to exhibit a non-universal power-law behavior at large scales while not exhibiting a wide inertial range. A related problem involves diffusion and transport in active systems, such as active bacterial baths, chemically propelled catalysts, field-driven colloids, and macroscopic entities (e.g., fish, insects, birds, etc.), among other active systems, where the units driving the motion generate local forces that overwhelm the thermal agitation if observable. Such systems exhibit not only a wealth of directed collective behavior but also regimes where the collective motion is on average non-directional, which gives rise to active (self-driven) diffusion.

Accordingly, turbulent fluid motion has been one of the longstanding unsolved challenges of theoretical physics. A predictive description of active fluids is challenging due to, among other things, the complexity of the individual building blocks (e.g., bacteria, molecular motors, etc.). In this respect, a simple physical model system, where interactions between particles are well characterized, is highly desirable and would be highly useful.

SUMMARY

At least one implementation of the invention relates to a system for mixing particles. The system includes a liquid comprising inert particles and defining a liquid and air interface; magnetic microparticles suspended at the liquid and air interface; and a magnetic source configured to apply a uniaxial alternating magnetic field parallel to the liquid and air interface, wherein the uniaxial alternating magnetic field promotes a turbulent motion of the magnetic microparticles, which in turn promotes a diffusive motion of the inert particles.

At least one implementation of the invention relates to a method of mixing particles. The method includes providing a liquid comprising inert particles and defining a liquid and air interface; suspending magnetic microparticles at the liquid and air interface; and promoting a turbulent motion of the magnetic microparticles by applying a uniaxial alternating magnetic field parallel to the liquid and air interface using a magnetic source, wherein the turbulent motion promotes a diffusive motion of at least one of the magnetic microparticles and the inert particles.

Additional features, advantages, and embodiments of the present disclosure may be set forth from consideration of the following detailed description, drawings, and claims. Moreover, it is to be understood that both the foregoing summary of the present disclosure and the following detailed description are exemplary and intended to provide further explanation without further limiting the scope of the present disclosure claimed.

BRIEF DESCRIPTION OF THE DRAWINGS

FIG. 12 shows the rotating spinners; FIG. 13 shows that the flows are concentrated around the spinners; and FIG. 14 shows a distinction between clockwise rotating spinners and counterclockwise rotating spinners. The normalized velocity magnitude $v/v_{max}$ and normalized vorticity $\omega/\omega_{max}$ fields are visually similar for the experiment (top of figure) and the simulation (bottom of figure). $\omega/\omega_{max}$ enables a distinction between clockwise and counterclockwise rotating spinners. Streamlines are superimposed to give a sense of flow.

DETAILED DESCRIPTION

Figure 1:
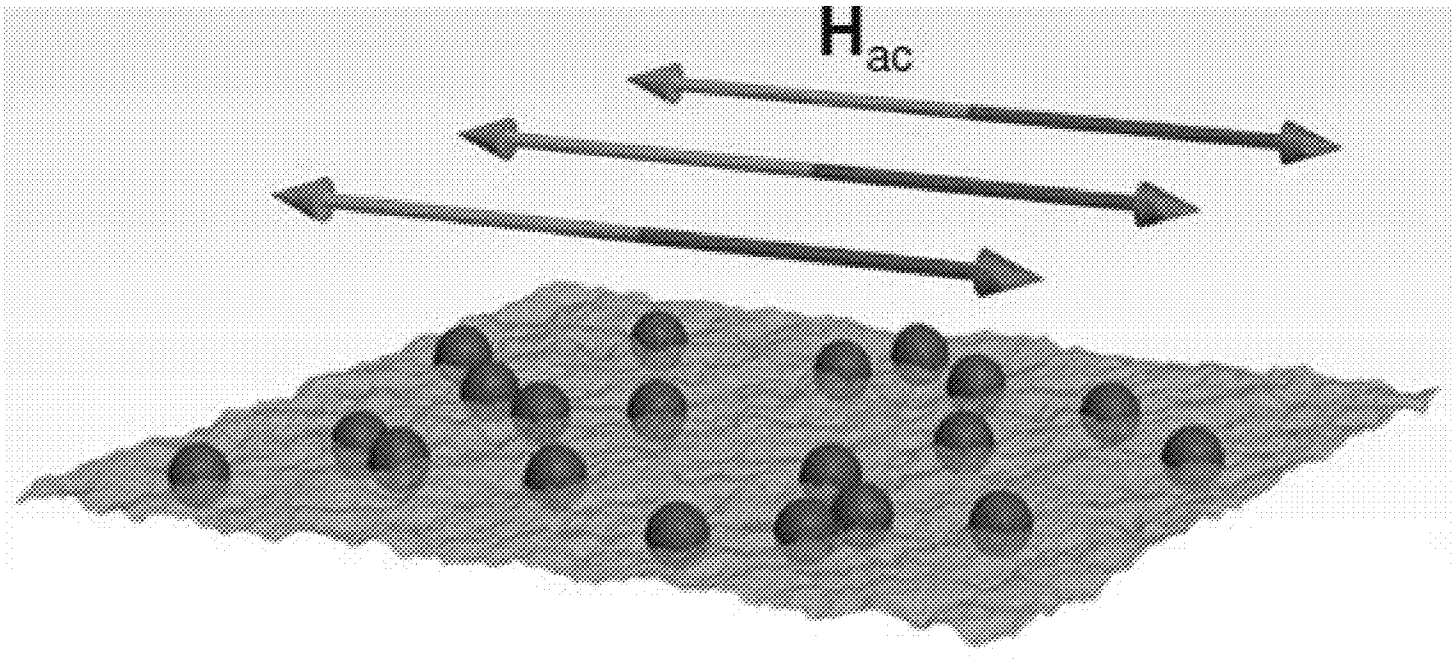
FIG. 1 is a schematic view of a single-axis alternating magnetic field applied parallel to a liquid-air interface containing micro-particles suspended at the interface.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

Disclosed herein are systems and methods involving turbulent mixing by microscopic self-assembled spinners (e.g., micro spinners). Herein we use nickel, but the spinners can be created by any assembly of particles that possesses a permanent magnetic moment (ferromagnetic or ferrimagnetic materials such as iron oxides, cobalt iron alloys, rare earth magnets, etc.). The particle diameter range displaying micro-spinner formation was between 30 and 150 μm for nickel, but the process is generic and can be used for bigger particles (millimeter and above) provided that enough magnetic field strength is available. In general, the existence of the spinner phase depends on the interplay of magnetic forces (determined by the particle magnetic moment and external field parameters), viscous drag forces (determined by the medium viscosity) and the packing fraction of active particles. The spinner phase can be induced at a liquid interface (any liquid/gas or liquid/liquid interface where the interfacial tension is enough to support particles and the liquid does not wet the particles). The spinner phase can also be induced at a solid/liquid interface (particles sediment at the container's bottom). The systems/methods can use an ensemble of magnetic micro-particles suspended on the surface of a liquid and energized by an in-plane single-axis magnetic field to provide efficient mixing at macro, micro, and nano-sized or scaled components (e.g., particles, bacteria, etc.). In a certain range of excitation field parameters (amplitude, frequency) a dynamic self-assembly phenomenon leads to the emergence of spontaneously rotating magnetic spinners, self-assembled microscopic chains of magnetic particles rotating in arbitrary directions, such as in clockwise and/or counterclockwise directions. Self-assembled spinners generate vigorous vortical flows at the interface and exhibits chaotic dynamics due to self-generated advection flows. Erratic motion of spinners at the interface generates chaotic fluid flow reminiscent of hydrodynamic turbulence. Turbulent flows allow very efficient fast mixing of any components or constituents (e.g., liquids, particles, etc.) at the interface.

The systems/methods allow one to effectively mix surface components in a fraction of time without affecting much the bulk of the liquid. The mixing ensemble could be then easily removed from the surface by the external magnetic field gradient (the permanent magnet could be used for this purpose). The technique is scalable from macroscale to microscale and could be used in microfluidic devices where standard mixing techniques could not be applied.

It has been found that the spinners and added inert particles exhibit active diffusion (e.g., diffusive motion is promoted by the activity of the system), while the diffusion arising from thermal noise is negligible. Further, the active diffusion coefficient increases nearly linearly with the spinner density and is approximately independent of the frequency of the driving magnetic field. The systems/methods reveal a non-monotonic dependence of the active diffusion coefficient on the inert particle size, where Stokes-Einstein relation holds for large inert particles (e.g., larger than a spinner) and diffusion is suppressed for small particles. The systems/methods also uncover dynamic segregation and clustering of spinners with the same sense of rotation.

Erratic motion of spinners in the container results in a turbulent-like 2D velocity field that exhibits the inverse energy-scaling $k^{-5/3}$ with wave number k, which is consistent with high-Reynolds number (Re) 2D turbulence, while Re≈30 for the flow-generating spinners in the systems. The results are reminiscent of observations of fluid velocities in forced turbulence in 2D conducting fluid layers, surfactant films, and 2D bubbly flows. Furthermore, observations during the experiments are in good qualitative agreement with the direct numerical simulations of discs suspended in a 2D fluid performed in the framework of a particle-based mesoscale hydrodynamic approach (multi-particle collision dynamics, MPC). Overall, the findings from the experiments and simulations expand our understanding of synthetic tunable active systems with activity originating from rotations rather than self-propulsion and provide predictive tools for active-particle manipulation at the microscale.

Experimental Setup

FIG. 1 illustrates a schematic view of a single-axis alternating magnetic field $H_{ac}$ applied parallel to a liquid-air interface containing microparticles suspended at the interface. In the experiments, ferromagnetic Ni microparticles (Alfa Aesar) with an average diameter of $\sigma$=90 μm (75-106 μm uniform size distribution) were dispersed at the water-air interface in a cylindrical beaker (diameter 5.5 cm, water depth 7 cm). The micro-particles (magnetic moment is about 0.01 $\mu A \cdot m^2$ per particle) were supported by the surface tension and remained confined at the interface throughout the experiments. The driving in-plane magnetic field [$B_x=B_0 \sin(2\pi f_B t)$, $B_0$=2.7 mT] was created by a pair of precision electromagnetic coils. The initial condition of each experiment was a fully dispersed assembly of microparticles achieved by applying a static magnetic field ($B_z$=16.25 mT) perpendicular to the water-air interface. Measurements were performed after the spinner phase was equilibrated for 30 s.

For the experiment, the number density of the system $S_A$ is defined as the total number of all magnetic microparticles divided by the total area of the liquid interface they occupy. Corresponding packing fractions in the experiments were in a range of 0.007-0.05. Also for the experiment, the Reynolds number is defined with respect to spinners and rotational flows they generate. A typical rotational velocity of the end point of a spinner is $\omega L_s/2$; the rotation rate is defined by the magnetic field frequency $f_B$; and the average spinner size $L_s$ at $f_B$=60 Hz is about 4 particle diameters (~400 μm). The Reynolds number is calculated as $Re=\pi f_B L_s^2/\eta \approx 30$; here $\eta$ is kinematic viscosity of water (bulk value).

Inert (e.g., nonmagnetic) particles for diffusion coefficient measurements were as follows: glass (Ceroglass Technologies Inc.: GSR-10 and GSR-5; Novum Glass LLC: U-150 and U-90) and polystyrene (Phosphorex Inc.: 2112G). The particle tracking and particle image velocimetry (PIV) were carried out with ImageJ, MatPIV package for Matlab, and custom codes. Hydrodynamic flows were visualized by spherical gold powder (3.0-5.5 μm, Alfa Aesar) and rheoscopic liquid (Novostar). The energy spectrum was calculated from a radially averaged 2D Fourier transform of the velocity field.

Simulation Setup

A 2D system was considered, with circular colloids embedded in an explicit solvent. A colloid includes 18 point particles of mass M, uniformly distributed over the circumference of a circle of diameter $\sigma$, with an additional point particle at the center. The shape is maintained by strong harmonic bonds, both between the nearest neighbors and each particle with the center. Each colloid carries a magnetic dipole; and the dynamics of the colloids is treated by standard molecular dynamics simulations. The embedding fluid is modeled by the multi-particle collision (MPC) approach, a particle-based mesoscale simulation technique believed to correctly capture hydrodynamic properties. Further employed was an angular-momentum conserving variant of an algorithm. As in the experiments, an oscillating external magnetic field leads to self-assembled spinners of average length $L_s \approx 3{:}51\ \sigma$ at the frequency $f_B \sigma/v=0.16$. The field strength was $B_0=0.8\sqrt{k_B T_{\mu 0}/a^3}$ and the magnetic moment of a colloid $\mu=480\sqrt{k_B T a^3/\mu_0}$, where a is the length unit (the size of MPC collision cell) and $\mu_0$ is the magnetic constant. The simulation results are presented in units of the colloid diameter $\sigma$ and the characteristic velocity v. The latter follows from the ballistic short-time mean square displacement (MSD) of passive particles. The spinner packing fraction $\phi_s$ is defined as a packing fraction considering each spinner as a disc of diameter $L_s$. The value $\phi_s$=0.113 corresponds to a colloid packing fraction of 0.028 in the range of the experimental values.

Results

Figure 2:
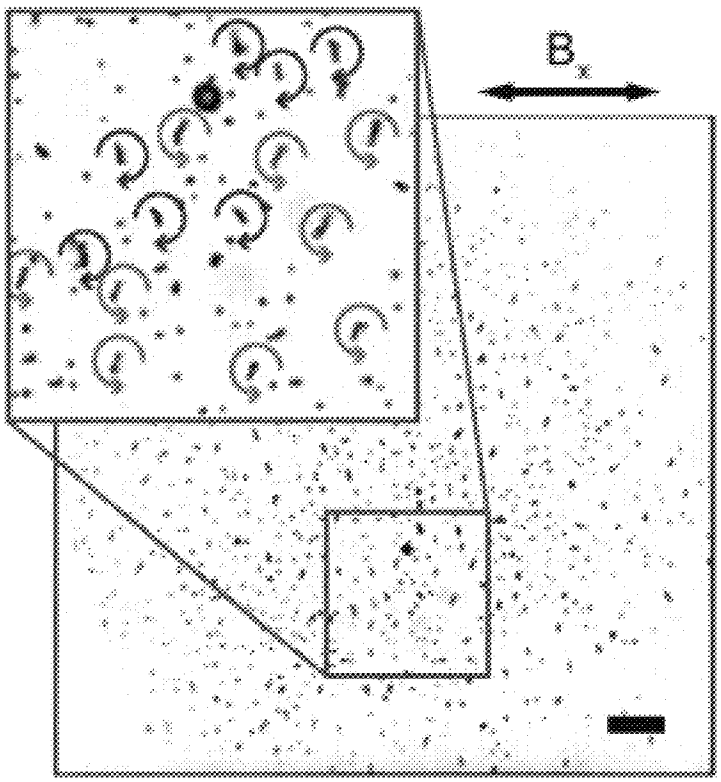
FIG. 2 shows an experimental snapshot of self-assembled magnetic spinners with an inert spherical particle. A uniaxial in-plane alternating magnetic field $B_x$ creates a swarm of spinners at the water-air interface. A non-magnetic particle is used to investigate diffusion. Inset shows a large inert particle and multiple clockwise and counterclockwise spinners.
Figure 3:
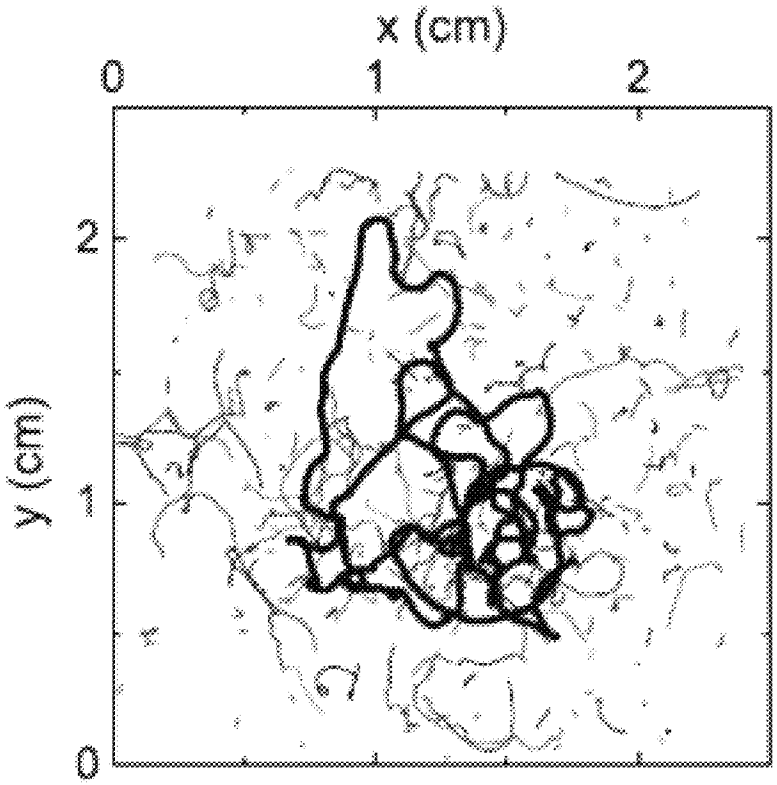
FIG. 3 shows a typical inert particle (thicker line) and spinner trajectories (thinner lines). The magnetic field amplitude $B_0$=2.7 mT and the frequency of the field $f_B$=60 Hz. The active particle number density $S_A$=3.5±0.5 $mm^{-2}$, and the inert particle diameter σ=500±20 μm.

It was found that out-of-equilibrium magnetic suspensions driven by a uniaxial in-plane magnetic field exhibit a peculiar spinner phase in a certain range of driving-field parameters. FIG. 2 illustrates that the spinner phase is populated by three subsystems of particles: active spinners, individual ferromagnetic colloids, and nonmagnetic (inert) particles. The magnetic spinners are self-assembled multi-particle chains of approximately equal length and are controlled by the frequency of the excitation field. The magnetic spinners include those that rotate clockwise and those that rotate counterclockwise. The length of each spinner is determined by a balance between magnetic and viscous torques exerted on a chain at the liquid interface and does not depend on a particle number density. The system is dynamic by nature, and magnetic particles frequently change their dynamic states (e.g., individual particles join spinners, spinners disintegrate into individual particles). The simulations (see Simulation Setup above) faithfully reproduced the observed phenomenology of the spinner phase. While the spinners are not self-propelling entities (activity comes from rotation only), the spinners get advected by the flows generated by the neighboring spinners. The motion of the spinners induces a large-scale vortical flow field, and the spinners are the dominant active component in the system inducing a diffusive motion of the inert particles. FIG. 3 illustrates short-lived active-spinner trajectories (thinner lines) and a long-lived inert particle trajectory (thicker line).

Dynamic Clustering of Spinners

Figure 4:
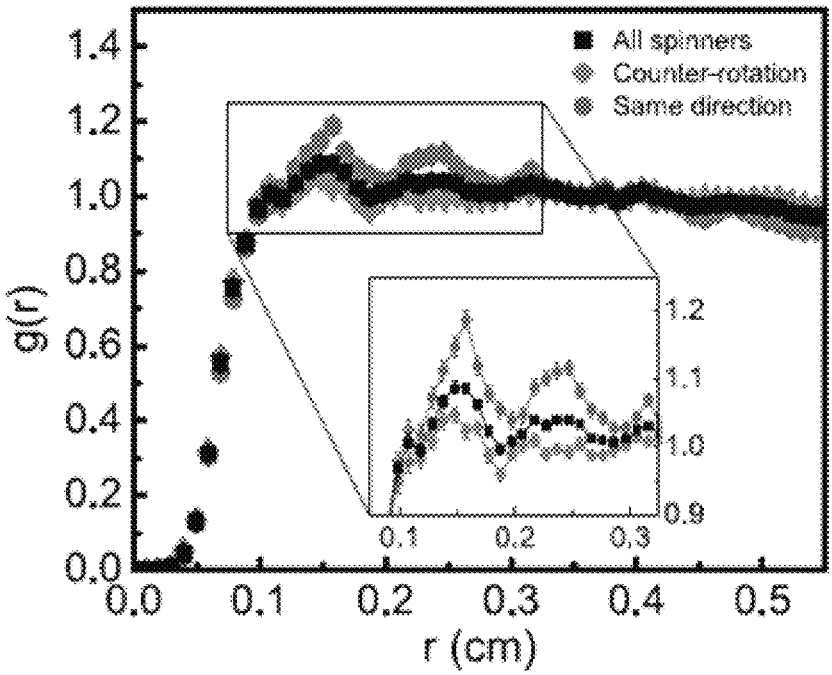
FIG. 4 shows normalized radial pair distribution function g(r) for all spinners (squares). A clustering can be observed by comparing g(r) for spinners rotating in the same direction (circles) and counter-rotating ones (diamonds). Inset is a blowup of the first two peaks.

As shown in FIG. 4, analysis of the spinner subsystem shows the presence of a short-range dynamic order in the spatial spinner arrangement (see the squares in FIG. 4). Also, the radial distribution function g(r) indicates more pronounced peaks for spinners with the same sense of rotation (see the circles in FIG. 4) compared with neighboring spinners rotating in the opposite direction (see the diamonds in FIG. 4). This apparent clustering is believed to be similar to that observed in simulations of higher density microrotors, where a macroscopic phase separation was numerically observed. However, the system here is significantly more complex because the spinner number is not fixed and fluctuates around a well-defined average prescribed by the parameters of the driving field, as the spinners are perpetually created and annihilated with a lifetime of the order of a second.

Active Transport and Diffusion

Figure 5:
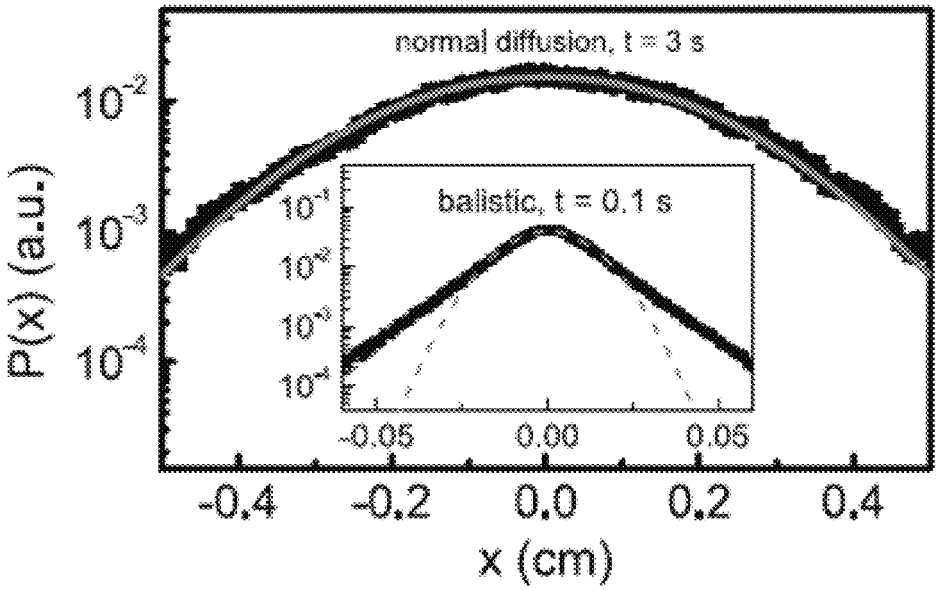
FIG. 5 shows the spinners' displacement probability distribution function, which indicates the diffusive (t=3 s) and the ballistic regime (t=0.1 s). Lines are least square fits to $\exp(-x^2/4Dt)$. The experimental parameters: $B_0$=2.7 mT, $f_B$=60 Hz, and $S_A$=3.5±0.5 $mm^{-2}$.
Figure 6:
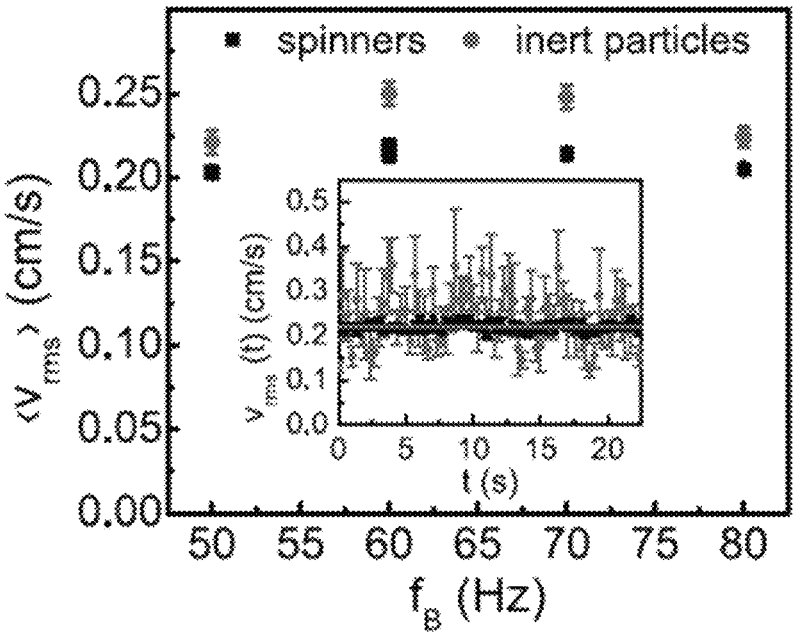
FIG. 6 shows the dependence of the time-averaged velocity ($v_{rms}$) on the frequency $f_B$ for spinners (squares) and inert particles (circles). (Inset) A typical time evolution of the root-mean-square velocity $v_{rms}$ at $f_B$=60 Hz; the line over time is a linear fit. $S_A$=3.5±0.5 $mm^{-2}$, σ=500±20 μm, and $B_0$=2.7 mT.

The spinners were found to erratically move over the water-air interface being advected by the self-generated flows. Two regimes of the spinner dynamics were identified. First, for relative short times, ballistic. Second, for relative long times, diffusive motion (see, FIG. 5). The ballistic motion is characterized by a mean velocity, which was chosen as root-mean-square (rms) velocity of the ensemble average over the spinners or inert particles, respectively—that is, $v_{rms}(t)=\sqrt{\langle v^2(t)\rangle}$. As displayed in FIG. 6, $v_{rms}(t)$ fluctuates around an average value as a function of time, where the displacements are larger for inert particles (FIG. 6, Inset). Correspondingly, the time average value $\langle v_{rms} \rangle$ of inert particles is ~10% larger than that of spinners. In the frequency range of the spinner phase, $\langle v_{rms} \rangle$ depends only weakly on the frequency of the applied external field.

Figure 7:
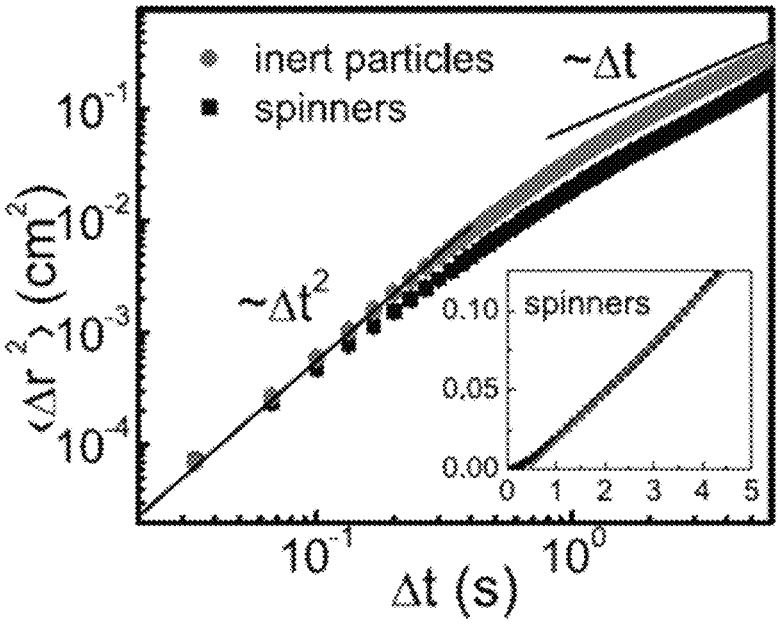
FIG. 7 shows the mean square displacements (MSDs) for spinners (squares) and inert particles (circles). The lines illustrate ballistic ($\propto\Delta t^2$) and active diffusion, with the same scaling as normal diffusion ($\propto\Delta t$). (Inset) The spinner MSD on linear scales. The red line is a least squares fit to Equation 1 for the active diffusive part of the curve. $f_B$=60 Hz, $S_A$=3.5±0.5 $mm^{-2}$, σ=500±20 μm, and $B_0$=2.7 mT.

A characteristic velocity scale can be estimated from the Stokes flow around a spherical (disk-like) particle of diameter $L_s$ (spinner length), which is given by $v(\bar{r})=\pi f_B L_s (L_s/2\bar{r})^{\delta-1}$ in δ dimensions. Here, the typical distance $\bar{r}$ of inert particles and spinners can be determined by the spinner concentration—that is, $\bar{r}\sim 1/\sqrt{S_A}$, where $S_A$ is the colloid number density. For the experimental parameters, this implies $v\approx 0.13$ cm $s^{-1}$, in reasonable agreement with FIG. 6. It is noted that the flow field decays less rapidly in strict two dimensions opposite to the quasi-2D experimental situation with 3D hydrodynamics, which implies larger characteristic velocities in simulations. To characterize activity-induced transport in the system, the diffusion coefficient D for spinners and inert particles was determined through the mean square displacement (MSD) using $\langle \Delta r^2 \rangle = 4D\Delta t$ [Equation 1] from both experimental and simulation results, as well as the probability distribution function $$P(r, t) \propto r\exp\left(-\frac{r^2}{4Dt}\right) \quad \text{[Equation 2]}$$

from experiments, wherein r is the displacement at time t. FIG. 7 illustrates the initial ballistic motion followed by a crossover to free diffusion. No anomalous diffusion was observed. The time scale for the crossover between ballistic and diffusive regime is set by the spinner mean free time (time between a collision with another spinner or a free particle). As discussed before, the $\langle v_{rms} \rangle$ is larger for inert particles than spinners. Consequently, the diffusion coefficient for inert particles is larger than that for spinners (see FIG. 9), which was attributed to hindered spinner motion due to their strong magnetic and hydrodynamic interactions with their neighbors. Simulations yield a similar behavior. However, the lifetime of the spinners in simulations just exceeds the crossover time between ballistic and diffusive motion such that no pronounced diffusive regime is obtained and no spinner diffusion coefficient can be extracted. In contrast, a clear diffusive regime is obtained for inert particles.

Figure 8:
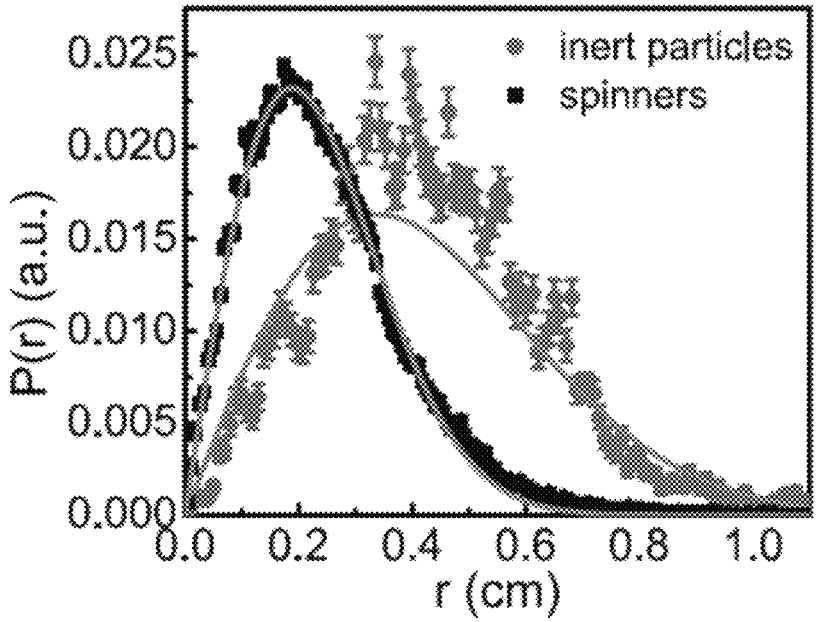
FIG. 8 shows the radial probability density function P(r) in the active diffusive regime for spinners (squares, t=3 s) and inert particles (circles, t=4 s). Curved lines are least squares fits to Equation 2. $f_B$=60 Hz, $S_A$=3.5±0.5 $mm^{-2}$, σ=500±20 μm, and $B_0$=2.7 mT.
Figure 9:
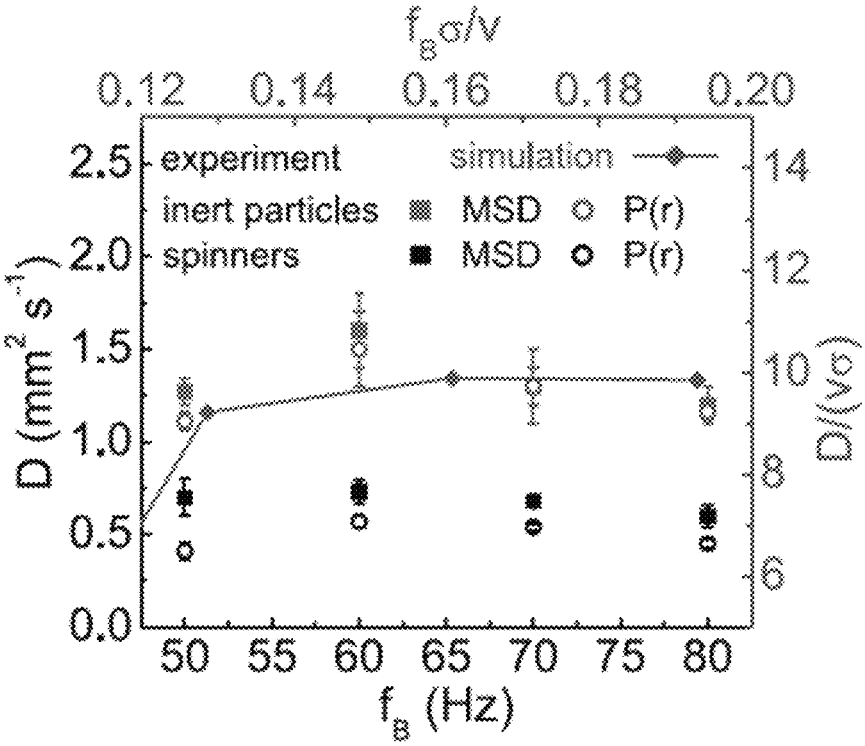
FIG. 9 shows the frequency dependence of the active diffusion coefficient for spinners (solid symbols) and inert particles (open symbols) as obtained from the MSD (squares) and P(r) (circles); $S_A$=3.5±0.5 $mm^{-2}$, and σ=500±20 μm. Results of simulations are shown for comparison using top and right side units. $B_0$=2.7 mT.

Diffusion coefficients for the spinners and inert particles are shown in FIG. 9 as a function of the frequency $f_B$. D values were extracted independently from the MSD and the displacement distribution functions P(r) (Equation 2) (see also FIG. 8). The latter figure shows that long-time displacements are well described by a Gaussian stochastic process. Further, there is a good agreement between the values extracted by the two methods and also qualitative agreement with simulation results. The frequency independence of the diffusion coefficient was attributed to a competition between a faster rotation leading to faster fluid motion and the decreasing spinner length with increasing frequency $f_B$ of the field (experiments and simulation show a similar trend).

Figure 10:
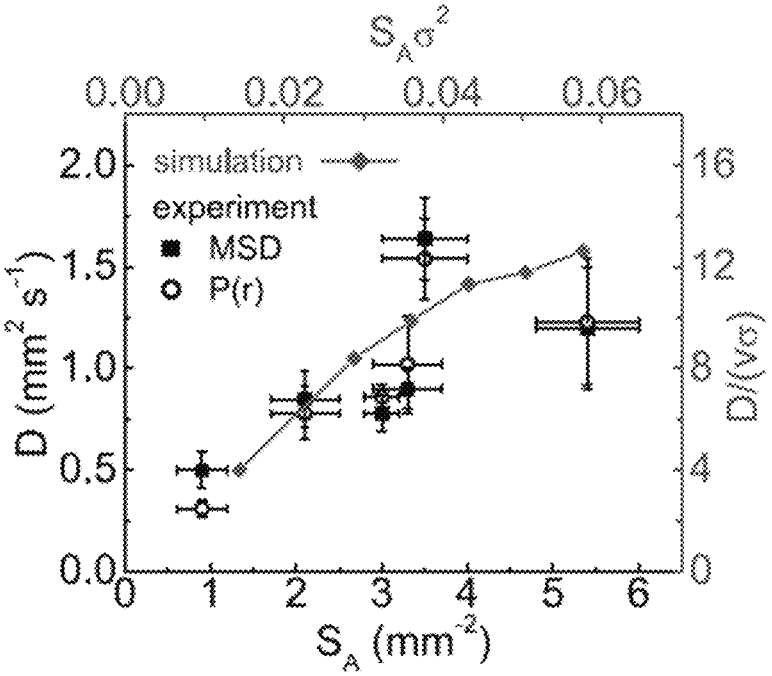
FIG. 10 shows the active diffusion coefficient as a function of the active particle number density $S_A$ for inert particles as obtained from experiments [MSD, squares, P(r); circles, $f_B$=60 Hz and $\alpha_T$=500±20 μm], and simulations are shown for comparison using top and right side units. $B_0$=2.7 mT.

The inert particle diffusion coefficient was analyzed at different active particle number densities $S_A$ to investigate the dependence of diffusion on activity in the system, and the obtained results are shown in FIG. 10. The inert particle diffusion coefficient exhibits a monotonic increase with the number density until the system becomes too dense to sustain the spinner phase (e.g., immobile agglomerates of magnetic particles are formed for high number densities). The observed nearly linear dependence qualitatively resembles previously observed enhanced tracer diffusion, such as in suspensions of swimming microorganisms. However, one should bear in mind that Reynolds numbers in suspensions of swimming microorganisms are typically much smaller than unity, whereas here Re≈30. Also, there are significant differences in the origin of the emerging flow fields: swimmers usually exhibit a characteristic dipolar flow field, while spinners create a rotational flow field.

Figure 11:
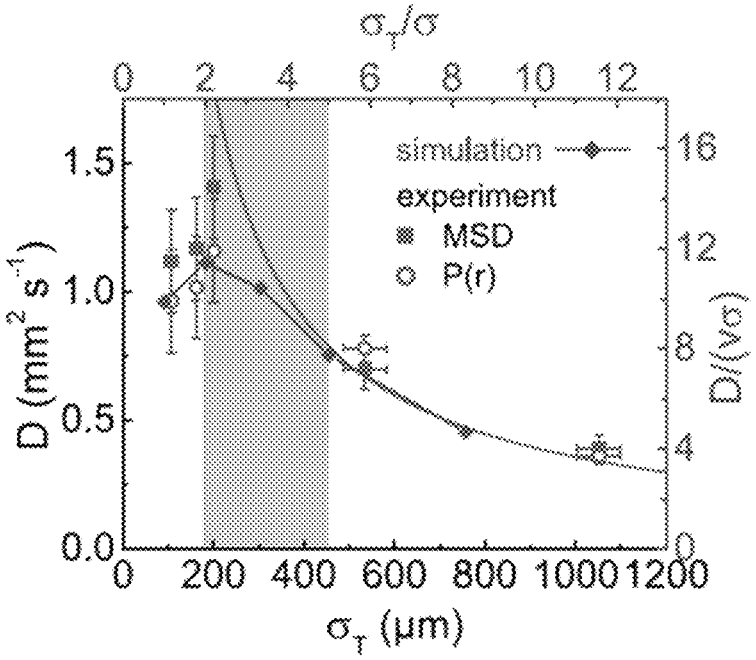
FIG. 11 shows the active diffusion coefficient is a non-monotonic function of the inert particle size for experiments [MSD, squares, P(r); circles, $f_B$=60 Hz and $S_A$=3.0±0.2 $mm^{-2}$] and simulations are shown for comparison using top and right side units. The curve (fit) line indicates the dependence $\sigma 1/\sigma_T$. The gray shaded area corresponds to the range of spinner sizes. $B_0$=2.7 mT.

Next, the inert particle size dependence of the diffusion was explored to gain additional insights on activity-induced transport in active spinner material. For inert particles larger than spinners (particle diameter $\sigma_T$>spinner length), the inert particle diffusion coefficient follows the Stokes-Einstein relation Doc $\propto 1/\sigma_T$, (FIG. 11). Hence, the stirred fluid appears as a random, white-noise environment. Remarkably, for smaller particles, the trend is inverted, and the diffusion coefficient decreases with size. The non-monotonic dependence indicates a change in the statistical properties of the ambient fluid. A diffusion coefficient independent of particle size appears to have been obtained, for example, for particles embedded in an active fluid with temporal exponentially correlated noise. In contrast, for larger particles, the fluid acts as a thermal bath. Similarly, a non-monotonic size dependence of particle diffusion was recently observed in bacterial suspensions. Thus, the monotonic dependence breaks down once a particle size becomes comparable with a characteristic fluid flows scale. In the system here, this scale approximately corresponds to the size of a spinner, while in a bacterial suspension, it is determined by a typical size of self-organized bacterial flows. Moreover, the results here imply that there is an optimal passive particle size for fastest mixing for a given active system, indicated by the maximum diffusion coefficient. These findings clearly demonstrate that active transport can be tuned. Simulations are in good qualitative agreement with the observed experimental trends (see FIGS. 9-11). The results of simulations are presented as dimensionless quantities, with σ and σ/v as relevant length and time scales. It should be noted, however, that the flow fields in three (experiment) and two dimensions (simulations) imply different velocities scales (as discussed herein). Therefore, a quantitative match is not expected. Despite that, both experiments and simulations yield the same dependencies of diffusion coefficients on the frequency, active particle density, and inert particle size (see FIGS. 9-11).

Energy Spectra

Figure 12:
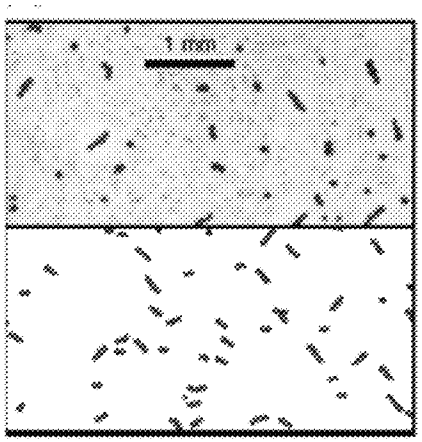
FIGS. 12-14 are selected snapshots comparing experimental (top of figure) and simulation (bottom of figure) states.
Figure 13:
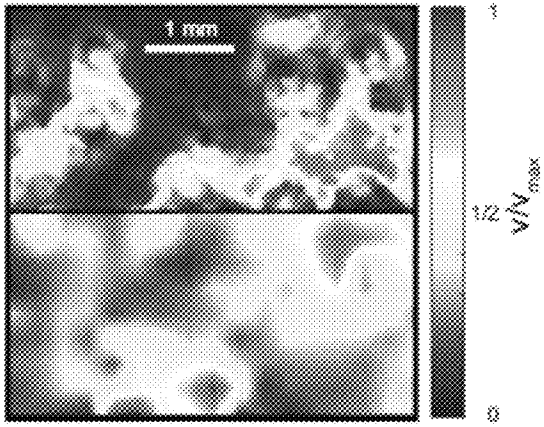
Figure 14:
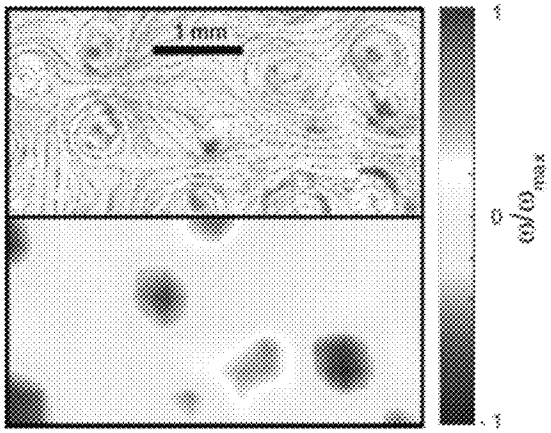
Figure 15:
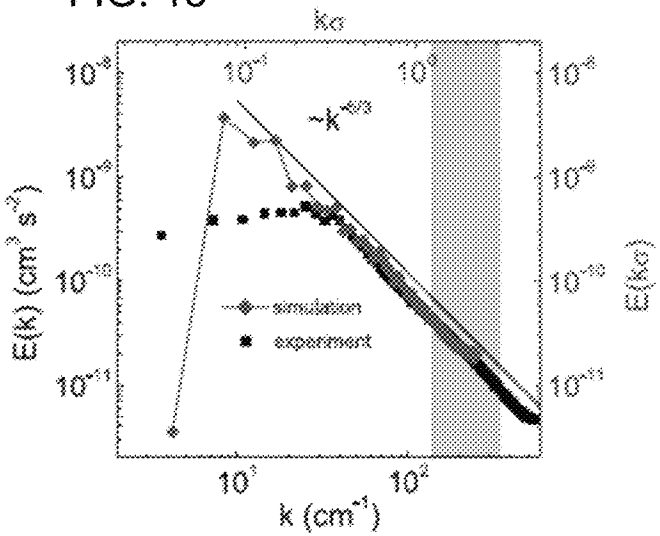
FIG. 15 shows Energy spectrum E(k) of the surface flows as obtained from experiments (squares) and simulations (diamonds). 2D turbulent flow reverse energy cascade toward small wave numbers k (large scales) with $k^{-5/3}$ scaling. The energy injection region is broad due to a heterogeneity of spinner sizes (gray shaded area). The experimental parameters are $B_0$=2.7 mT; $f_B$=60 Hz; and $S_A$=3.91±0.05 $mm^{-2}$. The simulation parameters are $f_B\sigma/v$=0.16; $\mu=480\sqrt{k_B T a^3/\mu_0}$; and $B_0=0.8\sqrt{k_B T_{\mu 0}/a^3}$. The graph illustrates the development of the turbulent behavior in the system.

The magnitude of the hydrodynamic velocity field, induced by the rotating spinners (e.g., shown in FIG. 12), illustrates that the flows are concentrated around the spinners (see FIG. 13). The energy spectrum of turbulent fluctuations in the system was calculated to further investigate the self-induced interface flows in the spinner phase. A typical energy spectrum E(k) of the flows as extracted from experiments is shown in FIG. 15, which resembles that of an inverse energy cascade in 2D turbulence. The broad energy-injection scale (gray shaded area shown in FIG. 15) arises from a spinner-size heterogeneity. Although the size constraints of our experimental and simulation systems limit the values of the accessible wave numbers k, a characteristic power-law behavior was observed over more than an order of magnitude in length scale. The power-law decay $k^{-5/3}$ of the energy spectrum showed no dependence on spinner density within the boundaries of the spinner phase and corresponds to that typically found in a high-Reynolds number turbulence.

The self-organized spinner systems encompass various sources of randomness, such as spinner size and life time. Also, the study of particle packing fraction effects is difficult, since spinners are stable in a very narrow packing fraction range only. The relevance of these aspects on the energy spectrum was investigated by performing simulations of spinners with a monodisperse length distribution at various concentrations. It was found that the energy spectra and corresponding exponents for the monodisperse systems with average spinner lengths $L_s=3\sigma$ and $4\sigma$ are similar to the exponent observed in the experiment and simulations (FIG. 15) for the polydisperse system, with average spinner length $\langle L_S \rangle \approx 3.5\sigma$. Hence, polydispersity is of minor importance for active turbulence in the system. Also, simulations of a polydisperse system with fixed length of spinners and length distribution of the self-organized system yield very similar energy spectra. Further increasing the spinner length in simulations $$\left(\frac{L_s}{\sigma} = 4-6\right)$$

led to the slight increase of the magnitude of the energy exponent. Simulations revealed that very short spinners $$\left(\frac{L_s}{\sigma} < 3\right)$$

behave like white-noise sources, and a minimal spinner length is necessary to generate turbulence at the considered Reynolds number. In addition, at high concentrations, the exponent starts to deviate from the hydrodynamic turbulence value, −5/3, since other interactions (e.g., steric or magnetic) become more relevant and the system undergoes a transition to another dynamic phase having nonrotating aggregates. Finally, the data also exhibits a crossover to a power law with exponent −3 at length scales smaller than the energy-injection scale, the value characteristic for enstrophy flux of hydrodynamic turbulence, both in 2D and 3D.

Mesoscale Turbulence (Relation to Other Systems)

The information gleaned from the experiments and simulations described herein offer application to many other areas. By way of example, similar turbulent behavior was observed for low-to-moderate Reynolds numbers in forced turbulence in, among other areas, 2D conducting fluid layers, surfactant films, and bubbly flows. In these instances, the turbulence was forced either by a fixed grid or by a fixed array of magnets (ordered or randomly positioned) beneath the films with a typical Re number in the range of $10^2$-$10^4$. The existence and robustness of the inverse energy cascade and (−5/3) scaling were established. Turbulent features have been also observed in viscoelastic polymer solutions (elastic turbulence) at Re numbers as low as $10^{-3}$, in which the turbulence was driven by a slow nonlinear response of the polymer solution to external shear due to long relaxation times of the polymers, and the corresponding exponent is believed to be close to (−1). In bacterial turbulence observed in dense bacterial suspensions, an apparent turbulent motion is associated with the onset of collective behavior, and the reported experimental exponents seem to be close to (−8/3). However, this scaling was observed only in a very narrow range of the wave numbers and for conditions not applicable to the systems here. This scaling behavior was attributed to an apparent visco-elastic response of highly concentrated bacterial suspension. In a follow-up study, active turbulence in a model of rigid self-propelled colloidal rods was explored through simulation(s), and power-law spectra with a classical exponent −5/3 consistent with hydrodynamic 2D turbulence in the inertial regime were observed. The system here is relatively dilute (1%-5% area fraction), and no collective motion has been observed. A feature of the experimental system here is that it actively injects vorticity at the microscale without self-propulsion. The injection process is spatially and temporally random due to perpetual self-assembly, advection, and collisions of spinners. It suggests that 2D turbulence might be fully developed over a much wider range of Reynolds numbers than in three dimensions, provided that the driving is spatially and temporarily random.

CONCLUSIONS

After investigating and detailing the transport properties of active spinner suspensions including self-assembled spinners with both clockwise and counterclockwise types of rotational symmetry, confined at a liquid-air interface, it has been found that the spinner suspension induces vigorous vortical flows at the interface that exhibit properties of well-developed 2D hydrodynamic turbulence despite the orders of magnitude lower Reynolds number (Re≈30). Further, the energy spectrum of generated flows shows the characteristic $k^{-5/3}$ decay. Therefore, the systems herein present a realization that non-equilibrium systems display active turbulence behavior. One unique aspect of these systems is that activity originates from rotations only and is not associated with self-propulsion. Further supporting the experimental observations are the simulation studies, which appear to match the experimental observations. Moreover, embedded inert particles exhibit an unusual diffusion behavior, a finding that illustrates that the active transport can be tuned by external parameters. Hence, active particle suspension constitutes a class of materials with tunable properties.

The systems/methods of this application provide faster and more efficient surface mixing compared to any other magnetic field-based mixing techniques. For example, the systems and methods can utilize mixing by multiple vortices to provide faster mixing, vortices of different chiralities (clockwise and counterclockwise) simultaneously present contributing to efficient mixing of components, and/or induced turbulent flows at a multitude of length-scales (e.g., simultaneous mixing at micro and macroscale), such as to provide a relatively high degree of mixing in a fraction of time. The systems and methods are, therefore, scalable from macroscale to microscale, such as for use in microfluidic devices, where standard methods fail (e.g., magnetic stir bar). Magnetic particles used for mixing could be functionalized by specialized ligands to effectively collect specific particles, bacteria, or macromolecules from the surface of the liquid, such as while creating vigorous, chaotic surface flows would make the collection process highly efficient. These and other advantages will be evident to a person of ordinary skill in the art.

The systems/methods disclosed herein have a broad range of application. For example, such systems/methods could be used to induce mixing in microfluidic devices and at reactive interfaces. Also, for example, if the particles could be functionalized with ligands, they could be used for the rapid collection of target analytes from interfaces. These and other applications will be evident to a person of ordinary skill in the art.

As used herein, the singular forms "a", "an" and "the" include plural referents unless the context clearly dictates otherwise. Thus, for example, the term "a member" is intended to mean a single member or a combination of members, "a material" is intended to mean one or more materials, or a combination thereof.

As used herein, the terms "about" and "approximately" generally mean plus or minus 10% of the stated value. For example, about 0.5 would include 0.45 and 0.55, about 10 would include 9 to 11, about 1000 would include 900 to 1100.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Other substitutions, modifications, changes and omissions may also be made in the design, operating conditions and arrangement of the various exemplary embodiments without departing from the scope of the present invention.

While this specification contains many specific implementation details, these should not be construed as limitations on the scope of any inventions or of what may be claimed, but rather as descriptions of features specific to particular implementations of particular inventions. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. A system for mixing particles, comprising:

a liquid comprising inert particles and defining a liquid and air interface;

magnetic microparticles suspended at the liquid and air interface; and a magnetic source configured to apply a uniaxial alternating magnetic field parallel to the liquid and air interface, wherein the uniaxial alternating magnetic field promotes the formation of microscopic spinning chains of magnetic microparticles resulting in a turbulent motion of the liquid, which in turn promotes a diffusive motion of the inert particles;

wherein the system has a non-monotonic dependence of an active diffusion coefficient on a size of the inert particles.

2. The system of claim 1, wherein the magnetic microparticles are self-assembled spinners within a range of an excitation parameter of the magnetic source.

3. The system of claim 2, wherein the excitation parameter comprises a frequency in a range of 50-80 Hz.

4. The system of claim 3, wherein the excitation parameter comprises an amplitude.

5. The system of claim 1, wherein the magnetic microparticles inject energy at a rate that is tunable in response to a frequency and an amplitude of the magnetic field.

6. The system of claim 5, wherein the magnetic microparticles form self-assembled microscopic chains that rotate in arbitrary directions in response to the magnetic field.

7. The system of claim 6, wherein the self-assembled microscopic chains of the magnetic microparticles generate vigorous vortical flows at the liquid and air interface, and the vortical flows are in response to a torque that is influenced by the rate of the injected energy.

8. The system of claim 7, wherein the self-assembled microscopic chains of the magnetic microparticles exhibit chaotic dynamics due to self-generated advection flows.

9. The system of claim 1, wherein the turbulent motion also promotes a diffusive motion of the magnetic microparticles.

10. The system of claim 9, wherein the diffusive motion is active diffusion that has the active diffusion coefficient that is a non-monotonic function of the active particle number density for the inert particles.

11. The system of claim 1 wherein the active diffusion coefficient for the inert particles is greater than or equal to $1.0\ mm^2s^{-1}$ and an active diffusion coefficient for the magnetic microparticles is less than $1.0\ mm^2\ s^{-1}$.

12. The system of claim 11, wherein each active diffusion coefficient is over a frequency in a range from 50-80 Hz.

13. A method of mixing particles, comprising:

providing a liquid comprising inert particles and defining a liquid and air interface;

suspending magnetic microparticles at the liquid and air interface; and promoting the formation of microscopic spinning chains of magnetic microparticles resulting in a turbulent motion of the liquid by applying a uniaxial alternating magnetic field parallel to the liquid and air interface using a magnetic source, wherein the turbulent motion promotes a diffusive motion of at least one of the magnetic microparticles and the inert particles;

wherein the method has a non-monotonic dependence of an active diffusion coefficient on a size of the inert particles.

14. The method of claim 13, further comprising adjusting a strength the turbulent motion of the magnetic microparticles using at least one of a frequency and an amplitude of the magnetic field.

15. The method of claim 14, wherein a range of the frequency is 50-80 Hz.

16. The method of claim 13, wherein the magnetic microparticles form self-assembled spinners that rotate in arbitrary directions in response to the application of the magnetic field, and wherein the self-assembled microscopic chains of the magnetic microparticles generate vigorous vortical flows at the liquid and air interface.

17. The method of claim 16, wherein the active diffusion coefficient for the inert particles is larger than an active diffusion coefficient of the magnetic microparticles.

18. The method of claim 17, wherein the active diffusion coefficient for the inert particles exhibits a monotonic increase with a number density until a density to sustain a spinner phase reaches a threshold.

19. The method of claim 13, wherein the active diffusion coefficient for the inert particles is greater than or equal to 1.0 $mm^2$ $s^{-1}$ and an active diffusion coefficient for the magnetic microparticles is less than 1.0 $mm^2$ $s^{-1}$, and wherein each active diffusion coefficient is over a frequency in a range from 50-80 Hz.

20. A system for mixing particles, comprising:

a liquid comprising inert particles and defining a liquid and air interface;

magnetic microparticles suspended at the liquid and air interface; and a magnetic source configured to apply a uniaxial alternating magnetic field parallel to the liquid and air interface, wherein the uniaxial alternating magnetic field promotes the formation of microscopic spinning chains of magnetic microparticles resulting in a turbulent motion of the liquid, which in turn promotes a diffusive motion of the inert particles;

wherein the turbulent motion also promotes a diffusive motion of the magnetic microparticles;

wherein the diffusive motion is active diffusion that has an active diffusion coefficient that is a non-monotonic function of the active particle number density for the inert particles.

21. A system for mixing particles, comprising:

a liquid comprising inert particles and defining a liquid and air interface;

magnetic microparticles suspended at the liquid and air interface; and a magnetic source configured to apply a uniaxial alternating magnetic field parallel to the liquid and air interface, wherein the uniaxial alternating magnetic field promotes the formation of microscopic spinning chains of magnetic microparticles resulting in a turbulent motion of the liquid, which in turn promotes a diffusive motion of the inert particles, wherein an active diffusion coefficient for the inert particles is greater than or equal to 1.0 $mm^2$ $s^{-1}$ and an active diffusion coefficient for the magnetic microparticles is less than 1.0 $mm^2$ $s^{-1}$.

22. A method of mixing particles, comprising:

providing a liquid comprising inert particles and defining a liquid and air interface;

suspending magnetic microparticles at the liquid and air interface; and promoting the formation of microscopic spinning chains of magnetic microparticles resulting in a turbulent motion of the liquid by applying a uniaxial alternating magnetic field parallel to the liquid and air interface using a magnetic source, wherein the turbulent motion promotes a diffusive motion of at least one of the magnetic microparticles and the inert particles;

wherein the magnetic microparticles form self-assembled spinners that rotate in arbitrary directions in response to the application of the magnetic field, and wherein the self-assembled microscopic chains of the magnetic microparticles generate vigorous vortical flows at the liquid and air interface;

wherein an active diffusion coefficient for the inert particles is larger than an active diffusion coefficient of the magnetic microparticles.

23. A method of mixing particles, comprising:

providing a liquid comprising inert particles and defining a liquid and air interface;

suspending magnetic microparticles at the liquid and air interface; and promoting the formation of microscopic spinning chains of magnetic microparticles resulting in a turbulent motion of the liquid by applying a uniaxial alternating magnetic field parallel to the liquid and air interface using a magnetic source, wherein the turbulent motion promotes a diffusive motion of at least one of the magnetic microparticles and the inert particles;

wherein an active diffusion coefficient for the inert particles is greater than or equal to 1.0 $mm^2$ $s^{-1}$ and an active diffusion coefficient for the magnetic microparticles is less than 1.0 $mm^2$ $s^{-1}$, and wherein each active diffusion coefficient is over a frequency in a range from 50-80 Hz.

* * * * *